United States Patent [19]

Miller

[11] 4,049,410

[45] Sept. 20, 1977

[54] GAS COMPRESSORS

[76] Inventor: Allan Sinclair Miller, Redbrook, Lower Dinedor, Hereford, England

[21] Appl. No.: 668,853

[22] Filed: Mar. 22, 1976

Related U.S. Application Data

[63] Continuation-in-part of Ser. No. 492,930, July 29, 1974, abandoned.

[51] Int. Cl.[2] ..... F25B 31/00; B25B 41/00

[52] U.S. Cl. ..... 62/197; 62/505; 418/84

[58] Field of Search ..... 62/505, 197, 222, 228, 62/510, 117; 418/97, 84; 62/225

[56] References Cited

U.S. PATENT DOCUMENTS

| | | | |
|---|---|---|---|
| 3,250,460 | 5/1966 | Cassidy et al. | 418/93 X |
| 3,379,033 | 4/1968 | Grant | 62/505 |
| 3,618,337 | 11/1971 | Mount | 62/505 |
| 3,667,247 | 6/1972 | Proctor | 62/225 X |
| 3,795,117 | 3/1974 | Moody, Jr. et al. | 62/505 |

*Primary Examiner*—William E. Wayner
*Attorney, Agent, or Firm*—Young & Thompson

[57] ABSTRACT

A gas compressor, such as a rotary vane one, for a refrigeration system is equipped with a supplementary inlet. By this gas in the liquid phase is injected into the compression chamber and reduces the temperature of the vaporized coolant gas as it is being compressed. This liquid gas is tapped from the normal refrigeration circuit. It can also be used, prior to injection, to cool oil circulated over the motor by a pump which the motor drives as well as the compressor.

3 Claims, 5 Drawing Figures

GAS COMPRESSORS

This application is a continuation-in-part of my copending application Ser. No. 492,930, filed July 29, 1974, now abandoned.

This invention relates to gas compressors. It is particularly but not exclusively concerned with compressors used in refrigeration, for compression of refrigerant gases such as Freon and Ammonia for example.

The invention is related to positive displacement rotary compressors and serves to increase substantially the application and flexibility of this type of compressor, which is increasing in popularity for closed gas cycles.

Figure 1:
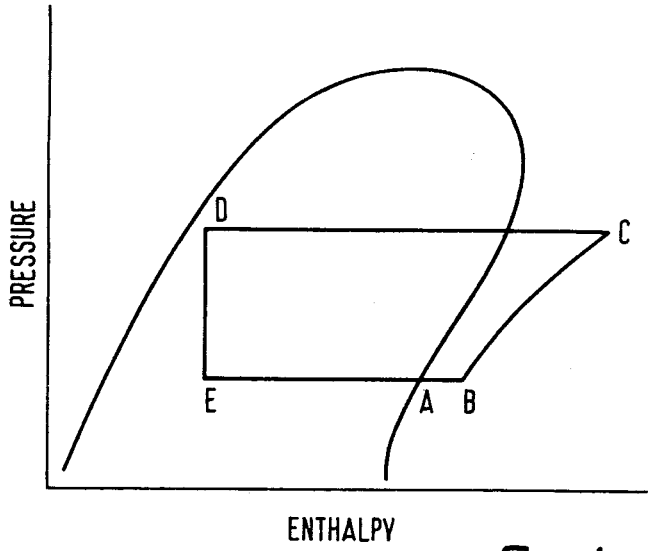
Figure 2:
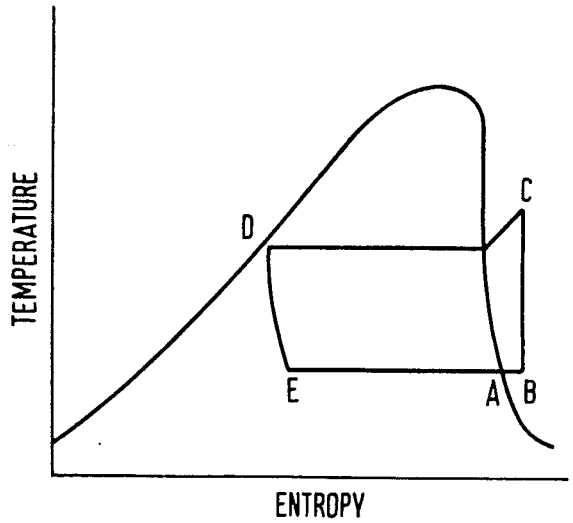

The basic cycle for a closed vapourisation-condensation process is illustrated graphically in FIGS. 1 and 2 of the accompanying drawings which respectively show Pressure - Enthalpy and Temperature - Entropy curves, and the following describes a typical refrigeration cycle. Reference is made to conventional refrigerator parts without preamble. At point A gas leaves the evaporator as a saturated vapour and, due to heat pick up in its passage, the gas normally enters the compressor at B in a slightly superheated condition. In practice the gas is generally 10°–20° C above saturation temperature when it enters the compressor compression chamber. The gas which is compressed reversibly and polytropically follows the constant entropy curve. At point C the gas leaves the compressor in a superheated condition at a higher temperature and pressure and enters the condenser where it is desuperheated and condensed reversibly at constant pressure. At point D it leaves the condenser as a high pressure, medium temperature, saturated liquid and enters an expansion valve where it is allowed to expand irreversibly and adiabatically at constant enthalpy. At point E it leaves the expansion valve as a low temperature, low pressure vapour and enters the evaporator where it is evaporated at constant pressure reversibly to the dry saturated point A at the commencement of the cycle.

Practical considerations such as pressure drop in the system will normally create minor deviations in the diagrams but these have been ignored in the explanation as they are irrelevant in the context of this invention.

The invention particularly relates to the compression part B-C of the cycle in the diagrams. Here there are two considerations which have significant influence in the use and application of compressors for closed gas cycles. The first is the power wasted in superheating the gas in the polytropic compression process, and the second is the practical problems associated with the heat generation in the compressor as a result of superheating the gas. In an ideal gas no superheating would occur during compression, and the index $n$ would be unity in the formula $PV^n$ = Constant.

$n$ = specific heat constant pressure/specific heat constant volume $n$ usually lies between 1 and 1.5.

The second point has not been a serious disadvantage in the past with slow reciprocating machines of generous proportions which provided an adequate mass of metal to dissipate the heat. The problem arises more acutely wth the development of modern high speed compact rotary compressors working at high compression ratios, where the relationship between body mass and heat generated is very different. This factor has severely handicapped the advancement of this type of machine. For example a modern rotary vane type of refrigeration compressor running at 3000 rpm is about one half of the physical size of a reciprocating compressor running at the same speed. The difficulty of taking full benefit from the many obvious advantages of positive displacement rotary compressors has restricted their use in the field of refrigeration to small machines operating at comparatively low compression ratios, i.e. under 4:1.

According to one aspect of the present invention there is provided a positive displacement gas compressor having means for injecting the gas in a liquid state into the compression chamber.

Conveniently, the compressor will be of the rotary vane type, although others may be used.

In a preferred form, the motor drives the compressor and an oil pump, which circulates oil as a coolant over the motor. A heat exchanger is disposed in the oil circuit and gas in a liquid state is passed through it before being injected into the compressor, thereby to cool the oil.

Also in a preferred form, there is provided means such as a thermostatic valve in a feedback circuit from the output of the compressor, whereby the rate of feed of the injected liquid is controlled in response to the superheat of the gas as discharged from the compressor. This feedback circuit also preferably includes means for positively ensuring that the supply of liquid is provided only when the compressor is in operation and ceases when the compressor stops.

According to another aspect of the present invention there is provided a compression refrigeration system wherein a selected quantity of condensed gas is fed back to the compressor to mix with and reduce the temperature of the varpourised gas as it is being compressed.

The gas can thereby be desuperheated during the actual process of compression, and this is preferably achieved by injecting an atomised spray of the liquified gas during an early stage after commencement of compression; the liquid being injected directly into the compression chamber.

Figure 3:
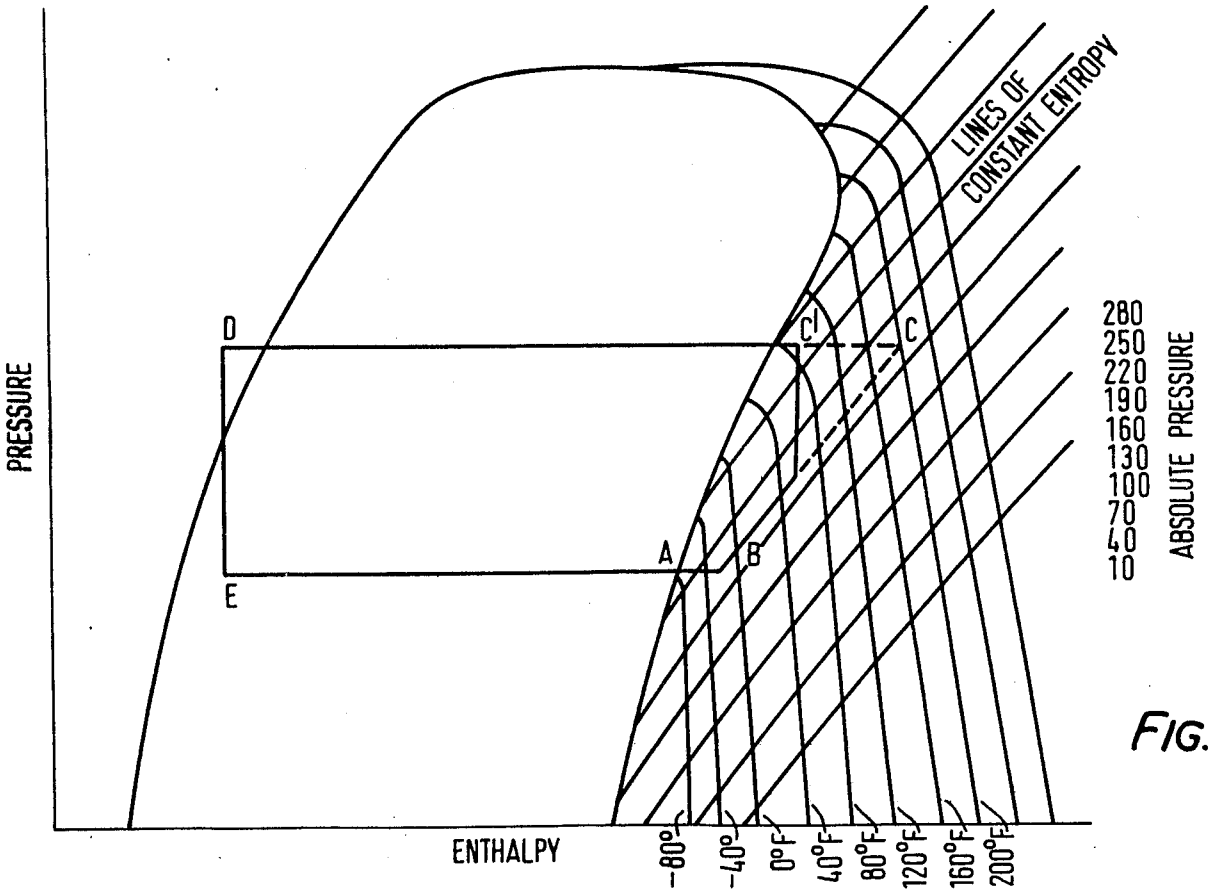
Figure 4:
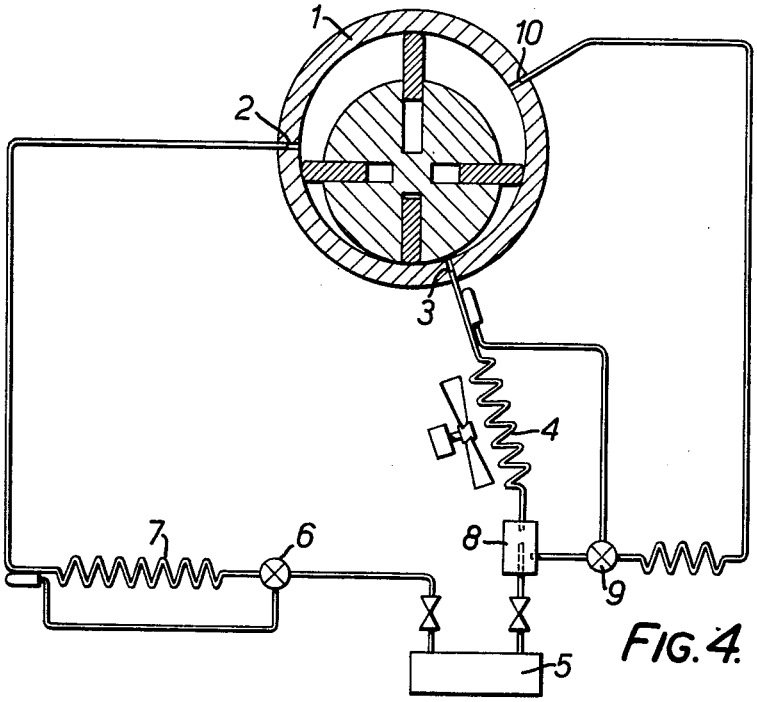
Figure 5:
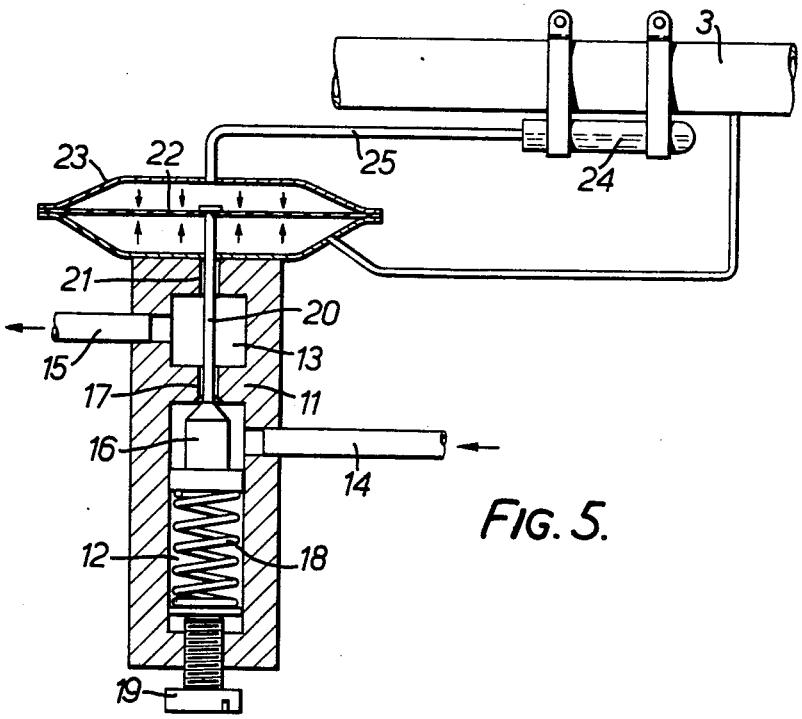
Figure 6:
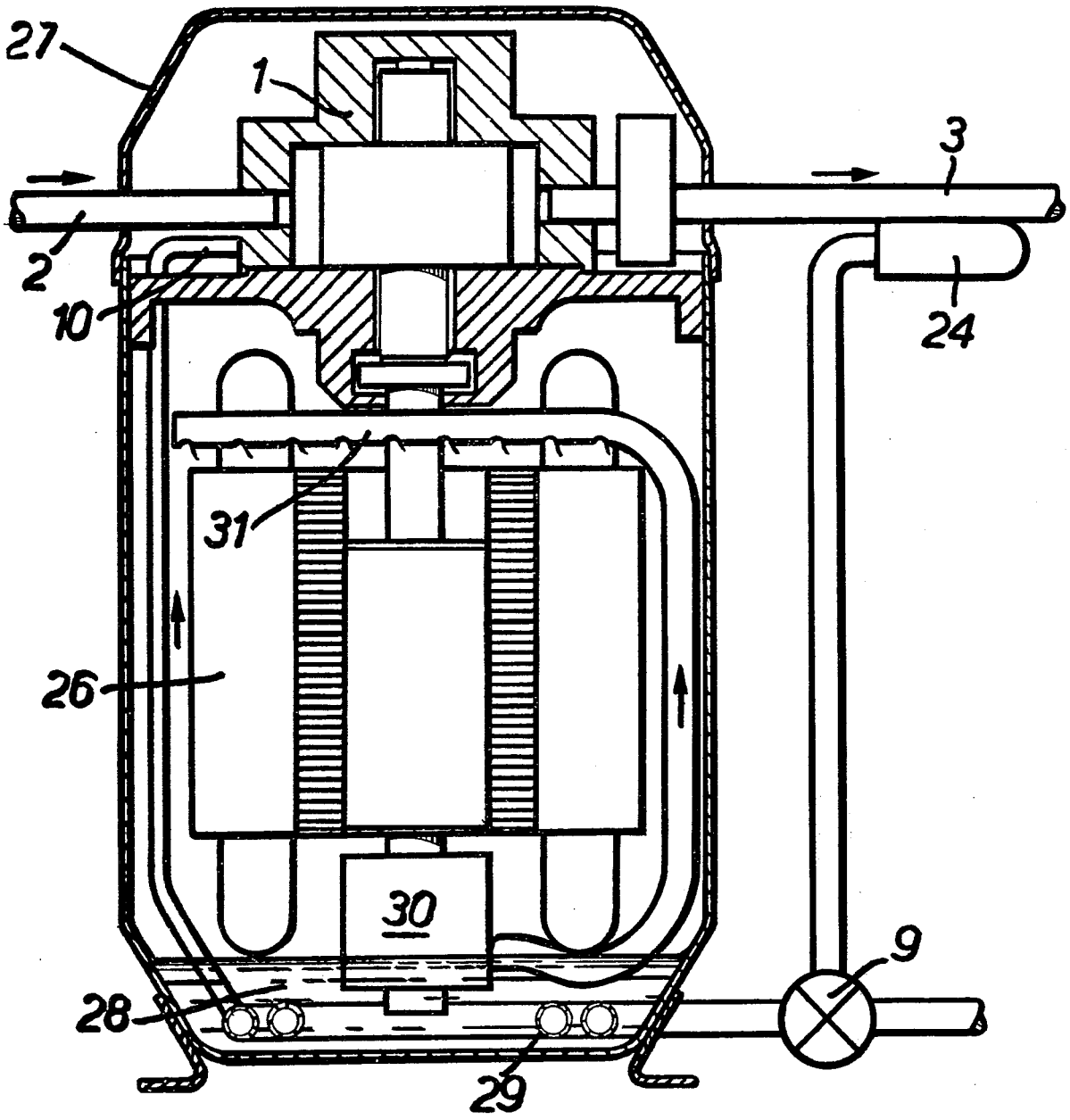

The invention may be performed in various ways and one constructional form will now be described, by way of example, with reference to the remaining figures of the accompanying drawings, in which:

FIG. 3 is a pressure-enthalpy graph for a gas used in refrigeration, also showing lines of constant entropy, FIG. 4 is a circuit diagram of a refrigeration system, FIG. 5 is a diagrammatic axial section of a thermostatic control valve used in the system of FIG. 4 and, FIG. 6 is a detail of FIG. 4, illustrating a cooling system for the motor-compressor assembly.

FIG. 3 is a more detailed version of FIG. 1 and illustrates characteristics of a typical Halocarbon gas used for refrigeration. At the commencement of the cycle of a known compression refrigeration system, as an example, gas leaves the evaporator (point A) at −80° F and having interchanged heat in subcooling the liquid refrigerant before its entry to the evaporator, enters the compression chamber (point B) in a superheated condition of −20° F. It is there compressed polytropically, i.e. along a curve of constant entropy, to 250 p.s.i.a. and 200° F, in which condition it enters the condenser (point C). The final stage of this compression is indicated in a broken line, but the corresponding elevation of temperatures to such a high value can be avoided, as described below.

Referring now to FIG. 4, a rotary compressor 1 of the vane type takes in gas at port 2 and discharges at port 3 to a heat exchanger 4. The gas is there condensed into liquid, and flows into a liquid receiver 5. From the receiver 5 the liquid is fed through an expansion valve 6 into a heat exchanger 7 where the liquid is evaporated, and the resultant gas is drawn into the compressor 1. This is a standard compression refrigeration circuit.

In addition, in the system of this invention there is a liquid trap 8 between the condenser 4 and the liquid receiver 5 from which liquid refrigerant is withdrawn through a control valve 9, to be injected at 10 into the compression chamber. The point of entry 10 is positioned just beyond the angle of rotation where compression commences. The exact position is not critical. The refrigerant enters the compressor 1 as an atomized liquid where it is vaporized on mixing with the hot gas. The latent heat of vaporization of the liquid desuperheats the gas during the compression process, and it can be arranged that an optimum quantity of liquid is fed into the compressor so that the temperature of the gas as it is compressed substantially follows the saturation curve on the pressure-enthalpy diagram. It happens in practice that for most commonly used gases in closed cycle systems, the energy required to compress the extra volume of gas is approximately equivalent to the energy saved in effectively changing the $PV^n =$ Constant effect in the thermodynamic process. The results of measurements from practical experiments with prototype systems revealed virtually no change in the power consumed with and without this injection at an intermediate point on the compressor. The effect of what I term the 'inter-stage injection' is illustrated in FIG. 3, compression following the bent solid line B-C' instead of the straight line B-C referred to above. It will be seen that the maximum temperature attained is much reduced.

An automatic control valve 9 is used to control the liquid feed and the invention embodies a thermostatic valve as shown in FIG. 5 and further described in the specification. This controls on the basis of the margin of superheat in the gas at the compressor discharge port 3. The valve can be set to maintain within quite close tolerances a specific gas temperature above the saturation temperature at any pressure pertaining. The valve has a body 11 with two co-axial interconnected chambers 12 and 13 which are respectively in communication via pipes 14 and 15 with the trap 8 and the inter-stage port 10. A valve member 16 is urged towards the throat 17 between the chambers by a spring 18, adjustable by means of a screw 19. A rod 20 extends from the member 16 freely through the throat 17, chamber 13 and a port 21 in the end of the body 11 to the center of a diaphragm 22 which spans and divides a shallow chamber 23. The upper side of this diaphragm is subject to the pressure of a fluid whose temperature and therefore pressure is directly related to that of the compressor discharge port 3, the fluid being confined in a capsule 24 held adjacent the compressor discharge port, the upper part of the chamber 23 and a connecting tube 25. It will be understood that according to the discharge temperature the diaphragm 22 is moved to adjust the valve member 16 via the rod 20 and so regulate the passage of liquid from the pipe 14 to pipe 15. In practice it would be normal to set the valve 9 to maintain a superheat of 6° to 10° F above the saturation temperature.

The valve operates as follows:

The diaphragm mechanism in the valve consists of a membrane dividing and balancing two independent pressure systems. The mechanism balances on one side the pressure of gas at the compressor exhaust plus the pressure exerted by the spring 12 — against the pressure exerted by the gas contained in the encapsulated system which is partly filled with a fluid in liquid form which is of the same nature as the working fluid in the system. It is important that the fluid contained in the capsule has the same or very similar temperature/pressure relationship characteristics as the working fluid; otherwise the valve would not control except within a very narrow band of pressures.

The capsule 24 which is held in contact with the exhaust gas passage, is maintained at the temperature pertaining at this point. The pressure within the capsule is, therefore, related to the temperature of the gas at the exhaust port.

Adjustment of the screw 19 alters the valve balance point. A rise in temperature at the compressor exhaust port causes a corresponding rise in pressure in the capsule and on the one side of the valve diaphragm. If the increase in pressure is not balanced by an equal and opposite pressure on the other side of the diaphragm, the valve spindle will be urged further off its seat to admit additional coolant. It will be understood from the foregoing that the valve will only respond to a change in superheat occurring and not merely to a change in temperature. This is a vital aspect of the valve function as otherwise the compressor would become flooded or starved at opposite ends of the condensing temperature operating range.

The purpose of the liquid trap 8 in FIG. 4 is to provide means for automatically and positively preventing the ingress of liquid into the compressor at any time except when it is running. The trap provides a continuous supply of refrigerant so long as the compressor is pumping and condensing the gas, but immediately the cycle stops the trap empties.

It has been actually demonstrated in practice that a machine operating, with the invention incorporated, at 3000 rpm on one of the most commonly used refrigerant gases Monochlorodifluormethane (F22) at compression ratios as high as 18:1 (which represents the practical limit for refrigeration machines) will operate with a body and bearing temperature as low as 120° with no form of external oil cooling. Without the invention described the compressor would need to be much larger in dimension in relation to its capacity and compression ratio would need to be restricted to a maximum of 4:1 and generally would require an external independent oil cooler. The scope of the compressor for general application is therefore increased out of all recognition. Whereas previously the rotary compressor, which has otherwise so many mechanical advantages in terms of size, cost, simplicity and smooth operation, was severely restricted in application and confined to small capacities for low compression ratio duties, the system described above offers a much greater scope for this type of machine for closed gas cycle applications, particularly in the field of refrigeration.

The above described system considerably eases the over-heating problem in the compressor, but there are further improvements in the design of the compressor itself which can be made.

Refrigeration motor-compressor assemblies generally fall into two categories:

1. Semi hermetic, where the motor and compressor are assembled together in what is virtually one gas tight body, and where the motor is cooled by external air cooling of the motor case combined with some cooling internally by circulating oil from the compressor over the motor.

2. Fully hermetic, where the motor and compressor are integrally assembly and the whole mounted within a gas tight pressure vessel and where the motor is cooled by allowing the return gas to pass over the motor windings before entering the compressor.

Both systems have disadvantages. In the fully hermetic case, the compressor efficiency in terms of work done per kw input is reduced as result of the heat imparted to the gas from the motor, which causes an increase in the specific volume of gas at the compressor intake. Also the motor cooling is absolutely dependent upon an adequate flow of gas over the motor. To ensure that this requirement is satisifed close constraints must be imposed on the permissible operating conditions, particularly in the case of low temperature work where the mass of gas circulating is low.

The semi-hermetic type of motor-compressor is usually operated with the motor windings close to their maximum safe limit. This is due to the lack of positive cooling which is normally dependent upon the motor being located in the air stream of the air cooled condenser.

A serious problem arises in the event of a motor burn out, a not infrequent occurrence with hermetic systems, and usually caused by moisture which is allowed to retain in the system due to careless dehydration before charging with refrigerant gas. Contact of the refrigerant with burnt insulation causes acid to be formed and this acid contaminates the entire system which, if not completely pruged and cleaned out, will attack the windings of the replacement motor which then rapidly fails. This problem has been frequent since the introduction of gas cooled motors, because the process of cleaning out a system "in the field" is difficult and costly and special equipment is required.

The modification to be described is aimed at providing an efficient method of cooling compressors as used in the refrigeration system described above. It enables full benefit to be taken of the tremendous advantages of the rotary compressor under all operating conditions and is independent of any external cooling influence. The modification also provides a means of cooling a motor without the risk of contaminating the system in the event of a motor burn out, since the refrigerant is not in contact with the motor windings. These are highly desirable requirements for any gas compressor designed for a wide range of refrigeration applications from low temperature cold rooms through to air conditioning and process plant. As a general rule hermetic and semi-hermetic compressors are designed for a specific part of the range.

Referring now to FIG. 6, there is shown part of the system of FIG. 4, but in more detail. The compressor 1 is driven by an electric motor 26, and they are contained in a single casing 27 which also forms an oil sump 28 for the motor cooling circuit. A heat exchanger in the form of a flat coil 29 forms part of the conduit for the interstage liquid from the control valve 9 to the compressor 1 and is disposed co-axially below the motor 26, so that the motor cooling oil is circulated over it. The motor 26 also drives a pump 30 mounted co-axially below it, which takes oil from the sump and distributes it over the motor by means of sparge pipe 31. Thus, liquid refrigerant from the condenser 4, fed and controlled by the thermostatic valve 9 is used to cool the oil as it returns to the sump.

During the passage of the liquid through the coil 29 part is boiled off, the latent heat of vapourisation being provided from the heat imparted to the oil by the motor. The remainder of the liquid passes on with the vapour to the inter-stage port 10 of the compressor. As described above, the quantity of liquid refrigerant is controlled on the basis of the superheat of the discharge gas from the compressor. There is always an adequate supply of refrigerant through the heat exchanger 29 to satisfy the cooling requirements of the motor. Since part of the liquid refrigerant will be varpourised in passing through the heat exchanger 29 the control valve 9 will adjust itself to allow for this and still provide sufficient liquid refrigerant to satisfy the thermodynamic process described above. In summary, the thermostatic control valve must regulate itself to satisfy two requirements:

1. To cool the oil for the motor.

2. To satisfy the thermodynamic compression cycle to maintain the required superheat.

Since the second requirement can only be met after satisfying the first requirement, and since the automatic control valve operates on the basis of measuring the final control temperature, which is the second requirement, the system, as a whole, is self regulating.

What is claimed is:

1. A refrigeration system including a positive displacement single stage rotary compressor with means providing a plurality of suction and compression chambers; means for injecting a single fluid only, that being the refrigerant gas in a liquid state, into an intermediate position on the compression side; a gas feedback circuit from the output of the compression side to said intermediate position, said circuit including means for liquifying gas from said output, means for positively ensuring that the supply of liquid is provided substantially only when the compressor is in operation and ceases when the compressor stops, a temperature sensor between said output and the liquifying means, and a valve responsive to said sensor between the liquifying means and said intermediate position, the sensor having a closed chamber containing fluid that is substantially directly influenced by the superheated gas from said output whereby it exerts a pressure directly related to the superheat temperature on a control member of said valve, and the valve having adjustment means whereby the valve can be set to maintain a desired degree of superheat of gas discharged from said output; a motor for driving the compressor, directly coupled thereto; means including a pump driven by and directly coupled to the motor for distributing a liquid coolant over said motor; and a heat exchanger in contact with the motor coolant through which gas in a liquid state is passed before being injected into said compressor, thereby to cool the coolant.

2. A refrigeration system as claimed in claim 1, wherein said liquefying means is a condenser and the valve is arranged to govern the feedback of a selected quantity of condensed coolant to said intermediate position of the compressor to mix with and reduce the temperature of the gas, and wherein the remainder of the gas is recirculated to the inlet of the compressor.

3. A refrigeration system as claimed in claim 1, wherein the compressor is of the rotary vane type.

* * * * *